US005287910A

United States Patent [19]

Colvin et al.

[11] Patent Number: 5,287,910

[45] Date of Patent: Feb. 22, 1994

[54] PERMANENT MOLD CASTING OF REACTIVE MELT

[75] Inventors: Gregory N. Colvin, Muskegon; Leonard L. Ervin, Whitehall; Robert F. Johnson, Spring Lake, all of Mich.

[73] Assignee: Howmet Corporation, Greenwich, Conn.

[21] Appl. No.: 943,704

[22] Filed: Sep. 11, 1992

[51] Int. Cl.[5] ..... B22D 18/04; B22D 18/06; B22D 21/00

[52] U.S. Cl. ..... 164/63; 164/65; 164/138; 164/493; 164/494; 164/495

[58] Field of Search ..... 164/138, 63, 65, 493, 164/494, 495, 512, 513, 514

[56] References Cited

U.S. PATENT DOCUMENTS

| | | | |
|---|---|---|---|
| 2,806,271 | 9/1957 | Operhall | 164/65 X |
| 3,005,246 | 10/1961 | Murphy et al. | 164/495 |
| 3,779,816 | 12/1973 | Mao | 164/138 X |
| 3,849,879 | 11/1974 | Kuchek | 164/63 X |
| 4,907,642 | 3/1990 | Gabis et al. | 164/63 X |
| 5,065,809 | 11/1991 | Sato et al. . | |
| 5,119,865 | 6/1992 | Mae et al. . | |

FOREIGN PATENT DOCUMENTS

| | | | |
|---|---|---|---|
| 705314 | 3/1965 | Canada | 164/495 |
| 61-273235 | 12/1986 | Japan | 164/138 |
| 2-284754 | 11/1990 | Japan | 164/138 |
| 833360 | 5/1981 | U.S.S.R. | 164/138 |

*Primary Examiner*—J. Reed Batten, Jr.
*Attorney, Agent, or Firm*—Flynn, Thiel, Boutell & Tanis

[57] ABSTRACT

Titanium based and nickel based castings are made by casting a suitable melt having a relatively low melt superheat into a mold cavity defined by one or more low carbon steel or titanium mold members where the melt solidifies to form the desired casting. The melt super-heat is limited so as not to exceed about 150° F. above the liquidus temperature of the particular melt being cast. For a steel mold, one or more titanium melt inlet-forming members are provided for cooperating with the steel mold members to form an melt ingate that communicates to the mold cavity for supplying the melt thereto in a manner to avoid harmful iron contamination of the melt during casting. The mold body-to-mold cavity volume ratio is controlled between 10:1 to 0.5:1 to minimize casting surface defects and mold wear/-damage.

15 Claims, 2 Drawing Sheets

PERMANENT MOLD CASTING OF REACTIVE MELT

FIELD OF THE INVENTION

The present invention relates to the casting of reactive metals/alloys and, more particularly, to permanent mold casting of reactive metals/alloys such as titanium based and nickel based materials.

BACKGROUND OF THE INVENTION

Titanium, titanium based alloy, and nickel based alloy castings are used in large numbers in the aerospace industry. Many such castings are made by the well known investment casting process wherein an appropriate melt is cast into a preheated ceramic investment mold formed by the lost wax process. Although widely used, investment casting of complex shaped components of such reactive materials can be characterized by relatively high costs and low yields. Low casting yields are attributable to several factors including surface or surface-connected, void type defects and/or inadequate filling of certain mold cavity regions, especially thin mold cavity regions, and associated internal void, shrinkage and like defects.

Permanent mold casting has been employed in the past as a relative low cost casting technique to mass produce aluminum, copper, and iron based castings having complex, near net shape configurations. However, only fairly recently have attempts been made to produce titanium and titanium alloy castings using the permanent mold casting process. For example, the Mae et al U.S. Pat. No. 5,119,865 issued Jun. 9, 1992, discloses a copper alloy mold assembly for use in the permanent mold, centrifugal casting of titanium and titanium alloys.

SUMMARY OF THE INVENTION

The present invention provides a mold and method for casting a titanium based and nickel based melt such as titanium, titanium alloys, and nickel based superalloys, to complex, net shape or near net shape, if desired, with improved yield, lower cost, and acceptable surface finish. The casting method involves forming a melt having a melt superheat selected to avoid mold damage and casting the melt into a mold cavity defined in mold means comprising at least one of an iron based material including, but not limited to, carbon steel and tool steel, and titanium based material including, but not limited to, titanium and titanium alloys.

Preferably, the melt superheat is selected so as not to exceed about 150° F., preferably 40° F., above the liquidus temperature of a particular charge to be melted and cast so as to avoid damage to the metallic mold. In one embodiment of the invention, the charge can be melted and heated by vacuum arc remelting to provide the relatively low superheat for casting into the mold.

In another embodiment of the invention, a differential pressure is established on the melt to be cast so as to assist filling of the mold cavity with the melt. The differential pressure can be established by evacuating the mold cavity relative to the ambient atmosphere while the melt is introduced into the mold. Alternately or in addition, the ambient atmosphere can be pressurized while the melt is introduced into the mold to provide such differential pressure.

In still another embodiment of the invention, the solidified casting is removed (e.g. ejected) while hot to avoid damage to the casting that could occur as a result of mold constraints associated with a particular complex casting configuration.

In still another embodiment, the mold walls defining the mold cavity include a ceramic layer thereon such as yttria, alumina, zirconia, ion nitrided and like layers.

A mold of the present invention comprises one or more mold members defining a mold body and selected from at least one of an iron based material and titanium based material. The mold members preferably comprise inexpensive low carbon steel or titanium alloys machined to define the desired mold cavity configuration.

In a preferred embodiment of the invention, the mold preferably includes one or more iron based mold members to define the mold body and mold cavity therein and one or more titanium based melt inlet-forming members that cooperate with the steel mold members to form a melt inlet or ingate that communicates to the mold cavity for supplying the melt thereto. The titanium based members typically define a pour cup and downfeed sprue that are subjected to the hottest and highest velocity melt where iron contamination of the melt otherwise would be likely. This composite mold avoids harmful iron contamination of casting.

A mold in accordance with another embodiment of the invention includes a mold body-to-mold cavity volume ratio controlled between 10:1 to 0.5:1, preferably between 2:1 to 1:1, to avoid casting surface defects and erosion, cracking, distortion and other damage to the mold during casting.

Details of the present invention will become more readily apparent from the following detailed description and drawings.

DETAILED DESCRIPTION OF THE INVENTION

Figure 1:
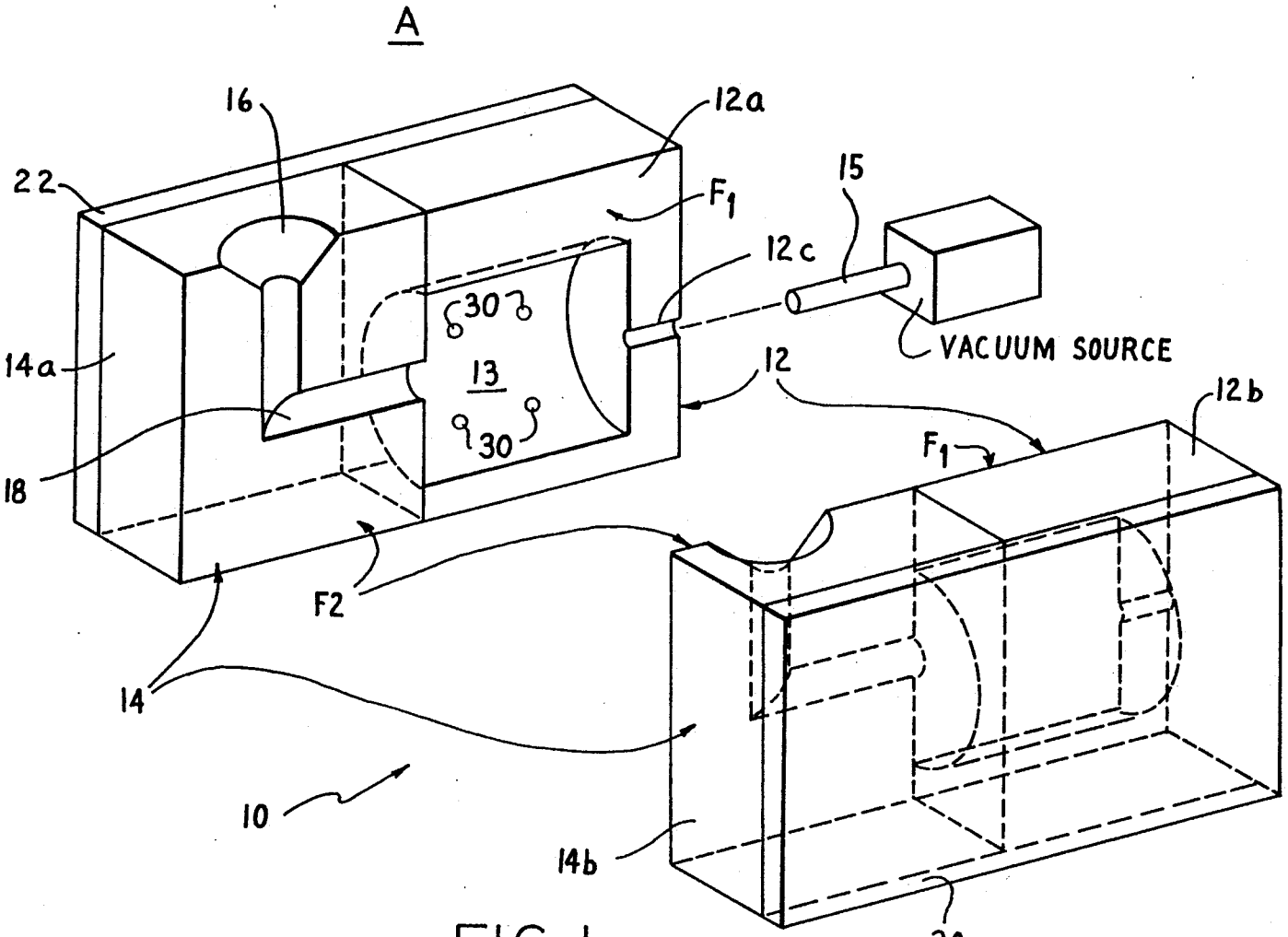
FIG. 1 is an exploded schematic perspective view of a mold in accordance with one mold embodiment of the invention for receiving a low superheat melt in accordance with one method embodiment of the invention.

Referring to FIG. 1, a mold 10 in accordance with one embodiment of the present invention for casting reactive titanium based material and nickel based material is illustrated. The mold 10 comprises a mold body 12 having a one or more mold cavities 13 (only one shown) defined therein and a melt inlet-forming body 14 for cooperating with the mold body 12 and forming a pour cup 16 to receive melt from a suitable source (not shown) and downfeed sprue or ingate 18 to supply the melt by gravity flow to the mold cavity 13.

The mold 10 is useful, although not limited to casting titanium based materials including, but not limited to, titanium and titanium alloys (e.g. Ti-6Al-4V and TiAl), and nickel based materials including, but not limited to, nickel based superalloys (e.g. IN-718 and IN-713C), representative of materials used in large numbers in the aerospace industry and some more recently in the internal combustion engine industry. The mold 10 is especially useful in casting these materials to a complex, net shape or near net shape with improved yield, lower cost, better surface finish, and improved dimensional control or tolerances as compared to investment cast counterparts. The mold cavity 13 can be configured to produce castings of simple and complex configuration for gas turbine engine use, such as vanes, structural components, housings, and the like, and internal combustion engine use, such as intake valves, exhaust valves, and the like.

The mold body 12 is illustrated as comprising first and second mold members (e.g. mold halves) 12a, 12b that are assembled together at the parting faces F1 to define the mold cavity 13 therebetween, although the invention is not so limited. For example, the mold body 12 may comprise a one-piece, monolithic body or a plurality of mold members assembled together. The mold halves 12a, 12b typically are machined to include complementary mold cavity features (i.e. halves of the mold cavity).

The melt inlet-forming body 14 is also illustrated as comprising first and second inlet-forming members or halves 14a, 14b that are assembled together at the parting faces F2 to form the pour cup 16 and downfeed sprue or ingate 18 therebetween. The inlet-forming members 14a, 14b typically are machined to include the complementary pour cup and sprue or ingate features shown.

Both the mold body 12 and the melt inlet-forming body 14 are backed or contacted on the outer side by water-cooled steel plates 20, 22 to extract heat from the bodies 12, 14 during casting of a melt therein and thereby prevent harmful overheating of the bodies. The cooling plates 20, 22 and the bodies 12, 14 are held together as a assembly by hydraulic clamping of bolts (not shown) extending through the mold bodies 12, 14 and plates 20, 22, or by any other suitable assembly means.

In accordance with an embodiment of the invention, the mold members 12a, 12b are made from iron based or titanium based mold materials. In particular, the mold members 12a, 12b can comprise steel, such as low carbon steel designated AISI 1040 or tool steel designated AISI H13, machined to define the desired mold cavity configuration therein. Other iron based materials useful for the mold members 12a, 12b include, but are not limited to, P20, H20, H21, and H22 steels and cast iron. The term iron based material is intended to include iron, steel and iron alloys where iron comprises a majority of the material.

Alternately, the mold members 12a, 12b can be made from a titanium based mold material. In particular, the mold members 12a, 12b can comprise unalloyed, commercially pure titanium and titanium alloys, such as Ti-6Al-4V (weight % basis). Other titanium based materials useful for the mold members 12a, 12b include, but are not limited to, Ti-6Al-2Sn-4Zr-2Mo (weight % basis). The term titanium based material is intended to include titanium and titanium alloys where titanium comprises a majority of the material.

The mold members 12a, 12b and the melt inlet-forming members 14a, 14b can be made of the same materials. For example, the mold members 12a, 12b and the melt inlet-forming members 14a, 14b all can be made of steel, such as the aforementioned low carbon steel or tool steel. Alternately, the mold members 12a, 12b and the melt inlet-forming members 14a, 14b all can be made of titanium, such as the aforementioned unalloyed titanium or Ti-6Al-4V alloy.

Preferably, the mold members 12a, 12b are made of steel, whereas the melt inlet-forming members 14a, 14b are made of a titanium based material, such as the Ti-6Al-4V alloy, to define the pour cup and downfeed sprue that are subjected to the hottest and highest velocity melt where iron contamination of the melt otherwise would be likely. This composite mold construction avoids harmful iron contamination of the titanium or nickel base melt during casting. Any slight dissolution of the titanium inlet-forming members 14a, 14b during casting is accommodated readily without adverse effects in casting titanium based materials or nickel based materials which usually include titanium as an alloyant. As will be apparent from Example 2 set forth herebelow, iron concentrations in the range of 0.18 to 0.21 weight % have been measured in Ti-6Al-4V castings made in such composite molds. These concentrations correspond to that present initially in the melt (i.e. no Fe pick-up from casting) and are within the iron specification maximum of 0.30 weight % for this alloy. In general, iron contamination must be avoided in titanium based and nickel based materials since iron forms brittle intermetallic phases that result in decreased mechanical properties for the alloy.

The surface or walls of the mold members 12a, 12b forming the mold cavity 13 can include a ceramic thermal barrier layer thereon to improve casting surface finish. The ceramic layer can comprise a yttria, alumina, zirconia or other ceramic coating applied on the aforementioned surfaces or walls. The ceramic layer can also comprise an ion nitrided surface zone on the mold cavity surfaces or walls; e.g. a titanium nitride zone or case. A yttria coating having a 0.002 inch thickness can be used on titanium or iron based mold surfaces in casting Ti-6Al-4V material.

The mold members 12a, 12b are provided with a mold body-to-mold cavity (casting) volume ratio selected between 10:1 to 0.5:1, preferably 2:1 to 1:1, for a mold cavity positioned generally geometrically centered in the mold body 12. These mold body/mold cavity volume ratios avoid casting surface defects and erosion, cracking, distortion and other damage to the mold during casting. In particular, mold body-to-mold cavity volume ratios greater than 10:1 chill the cast melt fast enough to produce surface and internal defects in the castings. The surface defects are generally voids which exhibit either point (porosity) or linear (flow lines) geometry. Other defects apparent at this ratio include surface connected shrinkage or unfilled casting sections. Mold body-to-mold cavity volume ratios less than 0.5:1 can cause the mold to heat to a temperature high enough to cause premature mold failure, despite the use of the water cooled plates 20, 22. Rapid mold heating can cause mold erosion, cracking, heat checks, or distortion which results in unacceptable dimensional and surface quality variation between cast components.

A mold body-to-mold cavity ratio of 2:1 to 1:1, especially 1:1, is preferred to produce the highest quality castings as Example 1 set forth herebelow will make apparent.

A destructible core (not shown) may be positioned in the mold cavity 13 so as to form a hollow casting. The core can be removed from the casting following removal from the mold by leaching, melting or other techniques.

In casting titanium based and nickel based materials in accordance with an embodiment of the invention, a charge of titanium based or nickel based material is melted and heated in a manner to limit the melt superheat to a level that will not damage the mold 10 during the casting operation. In particular, the charge is melted and heated so that the melt superheat does not exceed about 150° F., preferably 40° F. above the liquidus temperature of the particular charge composition. Typically, in practicing the invention, the charge in the form of a consumable electrode (not shown) is melted and heated by conventional vacuum arc remelting to provide the relatively low superheat melt for direct casting into the mold 10.

However, the invention can be practiced using other melting/heating techniques, such as induction skull remelting, electron beam remelting or vacuum induction melting, to provide the low melt superheat.

Casting of the titanium based or nickel based melt into the mold 10 can be facilitated by establishing a differential pressure on the melt effective to assist filling of all regions of the mold cavity 13 with the melt. The differential pressure increases the velocity of the melt flow into the mold 10 to reduce mold filling time, improve mold cavity filling, and reduce surface defects on the castings. As a result, the need for pressure in the downsprue 18 to assist mold filling is lessened, allowing its cross-sectional dimension to be reduced.

The differential pressure on the melt can be established by evacuating the mold cavity 13 relative to the ambient atmosphere A in the casting apparatus while the melt is introduced into the mold. An evacuation port **12*c* is provided in the mold body 12 and is connected to a suitable vacuum pump and conduit 15** to this end. Alternately or in addition, the ambient atmosphere A can be pressurized with an inert gas (e.g. Ar) while the melt is introduced into the mold to a level to provide such differential pressure. For example, the ambient atmosphere can be back filled with inert gas (e.g. Ar) to 500 microns, then the mold cavity can be evacuated to 15 microns, and then the melt can be introduced into the mold.

The melt solidifies in the mold 10 in 1–2 seconds to form the casting. The solidified casting is free of alpha surface case and exhibits a finer grain size than investment castings made of the same material (e.g. up to 50% smaller grain size).

Preferably, the casting is removed from the mold 10 while the casting is hot so as to avoid damage to the casting that would occur as a result of mold constraints thereon; e.g. mold constraints that arise with the casting of complicated casting configurations, where one or more regions of the casting is (are) subjected to tensile stresses sufficient to cause cracking, tears and other casting defects. For example, for Ti-6Al-4V castings, they can be removed from the mold 10 when the estimated casting temperature is about 800° F. Typically, the casting is removed from the mold 10 after a predetermined short time following introduction of the melt in the mold, at which time the melt will be solidified to form the casting which is still hot (at elevated temperature).

The casting can be removed by use of multiple ejection pins 30 movably disposed in one of the mold members **12*a*, 12*b* (e.g. as shown in mold member 12*a* in FIG. 1). The ejection pins 30 can be actuated to move or project into the mold cavity 13 (project 0.050 inch into the mold cavity) at the time the mold members 12*a*, 12*b*/inlet members 14*a*, 14*b* are separated. A hydraulic, screw or other suitable actuator can be used to move the ejection pins 30 into the mold cavity to engage the casting and eject it from the separated mold members 12*a*, 12*b***.

The casting can then be subjected to hot isostatic pressing and inspected in the same manner as used heretofore for investment castings. Since the casting made in the mold 10 does not have the alpha surface case typically present on investment castings, the casting does not require post-casting machining that investment castings require to remove the alpha surface case. Dimensional control of castings made in accordance with the invention is improved from one casting to the next as a result of the elimination of post casting machining operations (e.g. chemical machining) as well as by minimization of wear of the mold 10 and control led melt solidification rate in the mold 10.

The following examples are offered to illustrate, not limit, the invention.

EXAMPLE 1

Figure 2:
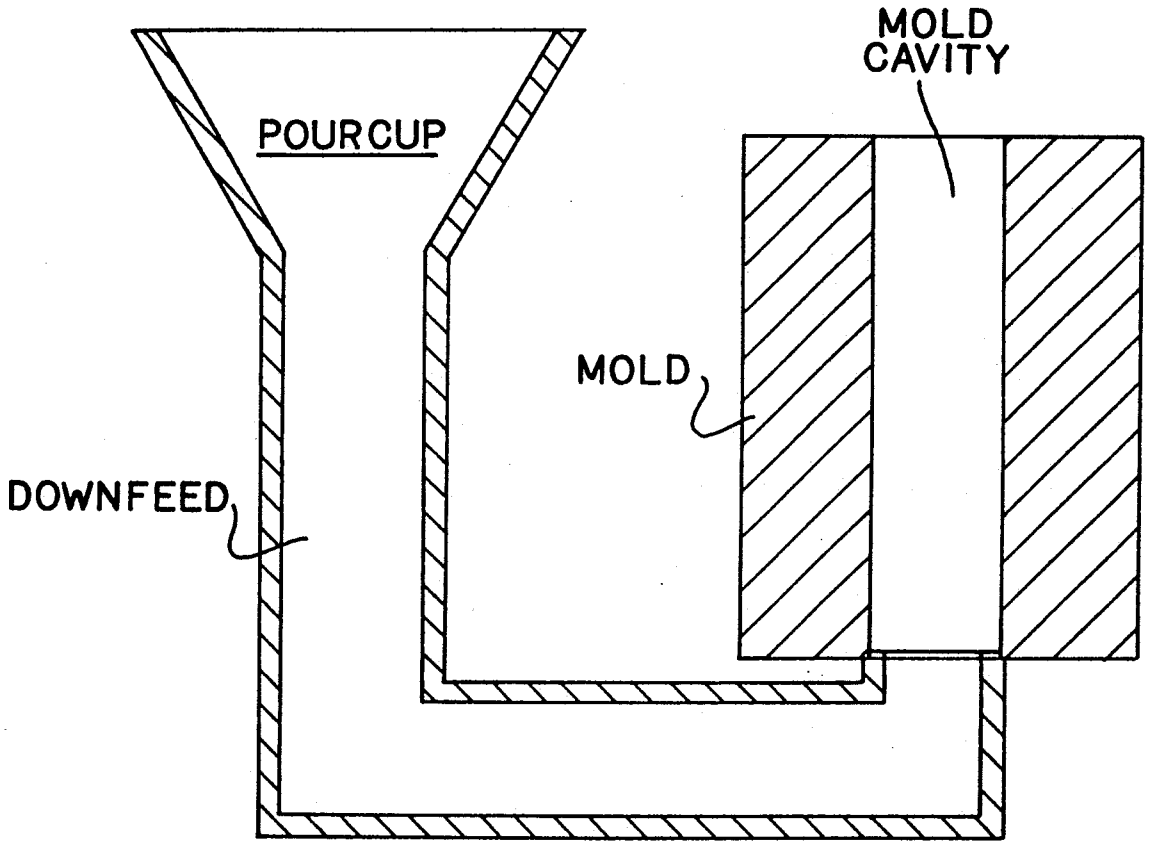
FIG. 2 is a schematic view of a mold used in making the castings of Example 1.

A series of casting trials was conducted to characterize the influence of mold body-to-casting (mold cavity) volume ratio on mold filling, casting surface finish, and mold integrity in casting a titanium alloy. To this end, four inch diameter 1040 steel bar stock and four inch diameter Ti-6Al-4V bar stock, both 6 inches in length, were machined to form a cylindrical cavity therein. The cavities ranged in diameter from 0.25 inch to 3 inch (e.g. 0.25 inch, 0.5 inch, 1.0 inch, 2.0 inch, and 3.0 inch in diameter) to provide a range of mold body-to-casting volume ratios from 250:1 to 0.8:1. All mold cavities had a length of 5.5 inches. The cylindrical molds were connected to a pour cup and downfeed sprue (shown in FIG. 2) formed of welded steel pipe (0.5 inch wall thickness). The pour cup and downfeed sprue (sprue diameter of 1 inch and height of 10 inches) were made of 1040 steel.

The mold was not backed by water cooled steel plates.

A Ti-6Al-4V consumable electrode was vacuum arc remelted directly into each mold in less than $4\times10^{-3}$ torr atmosphere using 4000 amps/36 volts. The melt temperature as-cast into the molds was approximately 3100° F. This represents 25° F. of melt superheat above the liquidus temperature (3075° F.) of the titanium alloy charge.

Mold body-to-casting (mold cavity) ratios greater than 10:1 produced severe linear and point surface defects due to the rapid heat extraction during solidification. Mold body-to-casting (mold cavity) ratios less than 10:1 produced substantially fewer casting defects. All mold cavities filled completely, and there was no mold damage noted. A mold body-to-casting ratio of 1:1 produced the highest quality casting surface with no detectable mold damage.

EXAMPLE 2

A composite mold similar to that shown in FIG. 1 was assembled from a pair of 1040 low carbon steel mold members and several Ti-6Al-4V melt inlet-forming members drilled to form the pour cups and down sprue features upon assembly. The mold cavity had dimensions of 0.4 inch diameter and 10 inches height. The downfeed sprue was 1 inch in diameter and 8 inches long. A mold body-to-casting ratio of 5:1 was used.

The mold members and melt inlet-forming members were backed by water cooled steel plates.

A Ti-6Al-4V consumable electrode was vacuum arc remelted directly into the mold in less than $5\times10^{-3}$ torr atmosphere using similar electrical power parameters as Example 1. The melt temperature as-cast into the molds was approximately 3100° F. This represents 25° F. of melt superheat above the liquidus temperature (3075° F.) of the Ti-6Al-4V alloy.

Over 70 castings were successfully made and exhibited only minimal as-cast surface defects. Two random castings were chemically analyzed. The analyses indicated Fe levels in the castings to be 0.18 and 0.21 weight %, respectively. These levels correspond generally with initial melt Fe levels (i.e. little or no Fe pick-up occurred during casting) and are within the specification of 0.30 weight % for Fe in the Ti-6Al-4V alloy.

While the invention has been described in terms of specific embodiments thereof, it is not intended to be limited thereto but rather only to the extent set forth in the following claims.

The embodiments of the invention in which an exclusive property or privilege is claimed are defined as follows:

1. A method of casting a titanium based or nickel based material, comprising casting a melt or said material through a melt inlet defined by at least one titanium based melt inlet-forming member and communicating to a mold cavity defined by multi-part, reusable mold means comprising at least one of an iron based material and titanium based material such that the melt flows through the melt inlet into the mold cavity where the melt solidifies to form a casting.

2. The method of claim 1, wherein the melt has a superheat not exceeding about 150° F. above the liquidus temperature said material.

3. The method of claim 1, wherein the mold means comprises at least one of iron, steel, titanium, and titanium alloys.

4. The method of claim 1, wherein said mold means includes a mold surface defining said mold cavity, said mold surface including a thermal barrier layer.

5. The method of claim 1, wherein the melt is cast into said mold means having a mold body-to-mold cavity volume ratio between 10:1 to 0.5:1.

6. The method of claim 1, wherein a differential pressure is established on the melt cast into the mold means to assist filling of the mold cavity with the melt.

7. The method of claim 6, wherein the differential pressure is established by evacuating the mold cavity relative to the ambient atmosphere.

8. The method of claim 6, wherein the differential pressure is established by pressurizing the ambient atmosphere relative to the mold cavity.

9. The method of claim 1, including removing the casting from said mold means while said casting is at elevated temperature.

10. A method of casting a melt comprising titanium and aluminum alloy, comprising casting the titanium and aluminum alloy melt through a melt inlet defined by at least one titanium based melt inlet-forming member communicating to a mold cavity defined by multi-part, iron based mold means such that the melt flows through the melt inlet into the mold cavity where the melt solidifies to form a casting.

11. A method of casting a melt comprising a titanium and aluminum alloy, comprising casting the alloy melt through a melt inlet defined by at least one titanium based melt inlet-forming member communicating to a mold cavity defined by multi-port, steel mold means such that the melt flows through the melt inlet into the mold cavity where the melt solidifies to form a casting.

12. A method of casting a titanium based or nickel based material, comprising casting a melt of said material through a melt inlet defined by at least one titanium based melt inlet-forming member communicating to a mold cavity defined by multi-part, reusable mold body comprising at least one of an iron based material and titanium based material and having a mold body-to-mold cavity volume ratio of 10:1 to 0.5:1 such that the melt flows through the melt inlet into the mold cavity where the melt solidifies to form a casting.

13. A method of casting a titanium and aluminum alloy, comprising casting a melt of said alloy into a mold cavity defined by a multi-part, reusable mold body comprising at least one of an iron based material and titanium based material and having a mold body-to-mold cavity volume ratio of 10:1 to 0.5:1 such that the melt flows through a melt inlet into the mold cavity where the melt solidifies to form a titanium aluminide casting.

14. The method of claim 13 wherein the melt has a superheat not exceeding about 150° F. above the liquidus temperature of the alloy.

15. The method of claim 13 wherein the mold body comprises at least one of iron, steel, titanium, and titanium alloys.

* * * * *

UNITED STATES PATENT AND TRADEMARK OFFICE

CERTIFICATE OF CORRECTION

PATENT NO. : 5,287,910

DATED : February 22, 1994

INVENTOR(S) : Gregory N. COLVIN, et al

It is certified that error appears in the above-identified patent and that said Letters Patent is hereby corrected as shown below:

Column 7, line 20; replace "or" with ---of---.

line 30; after "temperature" insert ---of---.

Column 8, line 19; replace "multi-port" with ---multi-part---.

Signed and Sealed this

Twenty-sixth Day of July, 1994

*Attest:*

*Attesting Officer*

BRUCE LEHMAN

*Commissioner of Patents and Trademarks*